US011489286B2

(12) United States Patent
Menez et al.

(10) Patent No.: US 11,489,286 B2
(45) Date of Patent: Nov. 1, 2022

(54) ELECTRICAL CONNECTOR WITH A MATE ASSIST SYSTEM

(71) Applicant: Aptiv Technologies Limited, St. Michael (BB)

(72) Inventors: Frédéric Menez, Hermeray (FR); Jean Fabre, Chartres (FR)

(73) Assignee: APTIV TECHNOLOGIES LIMITED

( * ) Notice: Subject to any disclaimer, the term of this patent is extended or adjusted under 35 U.S.C. 154(b) by 0 days.

(21) Appl. No.: 17/171,083

(22) Filed: Feb. 9, 2021

(65) Prior Publication Data

US 2021/0305749 A1 Sep. 30, 2021

(30) Foreign Application Priority Data

Mar. 27, 2020 (EP) ..... 20166374

(51) Int. Cl.
*H01R 13/62* (2006.01)
*H01R 13/629* (2006.01)

(52) U.S. Cl.
CPC . *H01R 13/62922* (2013.01); *H01R 13/62927* (2013.01)

(58) Field of Classification Search
None
See application file for complete search history.

(56) References Cited

U.S. PATENT DOCUMENTS 5,564,935 A 10/1996 Yagi et al.
5,873,745 A 2/1999 Duclos et al.
6,878,002 B2 * 4/2005 Osawa ..... H01R 13/62972 439/157
7,241,155 B2 7/2007 Tyler
7,462,047 B2 12/2008 Tyler
7,744,390 B2 * 6/2010 Tyler ..... H01R 13/62927 439/157
8,192,212 B2 6/2012 Casses et al.
9,780,487 B1 10/2017 Campbell et al.
9,917,402 B1 3/2018 Campbell et al.
(Continued)

FOREIGN PATENT DOCUMENTS

DE 69500824 11/1997
FR 2803111 A1 6/2001
(Continued)

OTHER PUBLICATIONS

Extended European Search Report for EP Application 20166374.7, dated Sep. 10, 2020, 6 pages.
(Continued)

*Primary Examiner* — Ross N Gushi
(74) *Attorney, Agent, or Firm* — Billion & Armitage

(57) ABSTRACT

An electrical connector having a mate assist system including a user actuatable member which slides along an operating direction between a rear position and a forward position, a first and a second rack sections extending parallel to the operating direction, and first and second rotatable cam members having a cam slot configured to receive a respective mounting pin protruding from a mating electrical connector. Each rotatable cam member engages a respective rack section and the first and second cam members rotate in opposite directions when the user actuatable member is moved from its rear position towards its forward position.

14 Claims, 3 Drawing Sheets

(56) References Cited

U.S. PATENT DOCUMENTS

| | | | |
|---|---|---|---|
| 10,109,952 | B2 | 10/2018 | Campbell et al. |
| 2018/0351294 | A1 | 12/2018 | Campbell et al. |

FOREIGN PATENT DOCUMENTS

| | | | |
|---|---|---|---|
| JP | 5146776 | B2 | 12/2012 |
| JP | 2013214436 | A | 10/2013 |
| JP | 2021053371 | A | 4/2021 |
| WO | 2013093546 | A1 | 6/2013 |

OTHER PUBLICATIONS

Translation of JP Office Action dated Aug. 30, 2022 for U.S. Appl. No. 17/171,083., 2 pages.
JP Office Action dated Aug. 30, 2022 for U.S. Appl. No. 17/171,083., 2 pages.

* cited by examiner

ELECTRICAL CONNECTOR WITH A MATE ASSIST SYSTEM

CROSS-REFERENCE TO RELATED APPLICATION

This application claims benefit of priority to European Patent Application No. 20166374.7 filed in the European Patent Office on Mar. 27, 2020, the entire disclosure of which is hereby incorporated by reference.

TECHNICAL FIELD OF THE INVENTION

The invention relates to an electrical connector, and, more particularly to a system for mating two electrical connectors with each other.

BACKGROUND

It is known to use mate-assist systems on electrical connectors, in particular when such connectors are used in automotive applications, and especially where either a high number of input/output connections per connector are required or where the terminal has a large cross-section often required for high power connections.

Such an electrical connector includes:

electrical terminals;

a housing having the electrical terminals accommodated therein; and a mate assist system for assisting in mating the electrical connector to a mating electrical connector, the mate assist system including

- a user actuatable member longitudinally slidably mounted on the housing to slide, along an operating direction, between a rear position and a forward position, the user actuatable member including a rack section extending parallel to the operating direction,
- a cam member rotatably mounted to the housing, including a cam slot for receiving a mounting pin extending from a side of a mating electrical connector, the cam member having a gear section with teeth engaging said rack section, the engagement of the teeth with the rack section resulting in the rotation of the cam member in a direction of rotation, when the user actuatable member is actuated from the rear position to the forward position.

When a high number of wires or cables are connected to the terminals and/or when cables with a large section are connected to the terminals, the cable harness becomes quite rigid. Further, the cables may be short and/or sometimes there is not much room around the connector and the mating connector. Then the bending of the cables may be difficult and consequently, it can be difficult to find a proper alignment of the connector and the mating connector along the mating direction.

Further, as schematically illustrated in FIG. 8, for an easy mating of the connector 1 with a mating connector 2, there are small clearances between their housings. With the connectors of the prior art, the engagement of the cam member 30 mounted on the connector 1 with the mounting pin 10 extending from the mating connector 2 results in efforts, only on one side of the connectors 1, 2, that rock and tilt the connector 1 with respect to the mating connector 2 (see arrow T). As consequences, not only is the mating of the connectors 1, 2 less easy (resulting from high efforts generated by the connector misalignment during the mating phase), but the reliability and the quality of the electrical contact between the terminals, as well as the reliability of possible sealing means, are not optimized because the connector 1 and the mating connector 2 may not be well aligned. Similarly, when the electrical connector 1 and the mating connector 2 are electromagnetically shielded, the shielding continuity can be degraded.

An aim of the disclosure is to present a connector and/or a connector assembly that at least partially mitigates the problems encountered with the prior art connectors.

SUMMARY

According to one or more aspects of the present disclosure, an electrical connector includes electrical terminals, a housing having the electrical terminals accommodated therein, and a mate assist system for assisting in mating the electrical connector to a mating electrical connector. The mate assist system includes a user actuatable member longitudinally slidably mounted on the housing configured to slide along an operating direction between a rear position and a forward position, a first rack section extending parallel to the operating direction, and a first rotatable cam member including a cam slot for receiving a first mounting pin extending from a first side of the mating electrical connector. The first cam member has a first gear section with teeth engaging the first rack section. The engagement of the teeth with the first rack section results in the rotation of the first cam member in a first direction of rotation when the user actuatable member is actuated from the rear position to the forward position. The mate assist system also has a second rack section extending parallel to the first rack section and a second rotatable cam member including a cam slot for receiving a second mounting pin extending from a second side of the mating electrical connector. The second side is opposite to the first side of the mating electrical connector. The second cam member has a second gear section with teeth engaging said second rack section. The engagement of the teeth of the second gear section with the second rack section results in the rotation of the second cam member in a second direction of rotation when the user actuatable member is actuated from the rear position to the forward position. The first direction of rotation is opposite to the second direction of rotation when the first cam member and the second cam member are viewed from a same side of the connector.

In one or more embodiments of the electrical connector according to the previous paragraph, respective cam slots of the first and second cam members share a cam race and the first and second cam members rotate about a shared axis.

In one or more embodiments of the electrical connector according to any one of the previous paragraphs, the user actuatable member includes the first and second rack sections and the first and second rotatable cam members are rotatably mounted to the housing.

In one or more embodiments of the electrical connector according to any one of the previous paragraphs, the user actuatable member has four walls generally extending in planes parallel to a longitudinal central axis and defining a generally rectangular cross-section, the first and second rack sections being located respectively on an inner surface of the user actuatable member and generally symmetrically arranged about the longitudinal central axis.

In one or more embodiments of the electrical connector according to any one of the previous paragraphs, the first and second rotatable cam members are identical.

In one or more embodiments of the electrical connector according to any one of the previous paragraphs, the housing has four outer surfaces generally extending in planes parallel to a longitudinal central axis and defining a generally rectangular cross-section, the first and second rotatable cam members being each respectively mounted on an opposed outer surface.

In one or more embodiments of the electrical connector according to any one of the previous paragraphs, the first and second rotatable cam members are each respectively mounted on opposed outer surfaces of the four outer surfaces, perpendicular to a line that joins two terminals.

In one or more embodiments of the electrical connector according to any one of the previous paragraphs, the electrical connector further includes locking means slidably mounted along a locking direction parallel to the operating direction, between an unlocking position and a locking position. The locking means engages at least one of the first and second rotatable cam members when the user actuatable member is in its forward position.

According to one or more aspects of the present disclosure, an electrical connector assembly includes the electrical connector according to any one of the previous paragraphs and a mating connector. First and second mounting pins are respectively arranged on opposite outer surfaces of the mating connector housing.

According to one or more aspects of the present disclosure, an electrical connector assembly includes the electrical connector according to any one of the previous paragraphs and a mating connector. First and second mounting pins protrude in opposite directions along a shared axis.

BRIEF DESCRIPTION OF THE DRAWINGS

The present invention will now be described, by way of example with reference to the accompanying drawings, in which.

DETAILED DESCRIPTION

Figure 1:
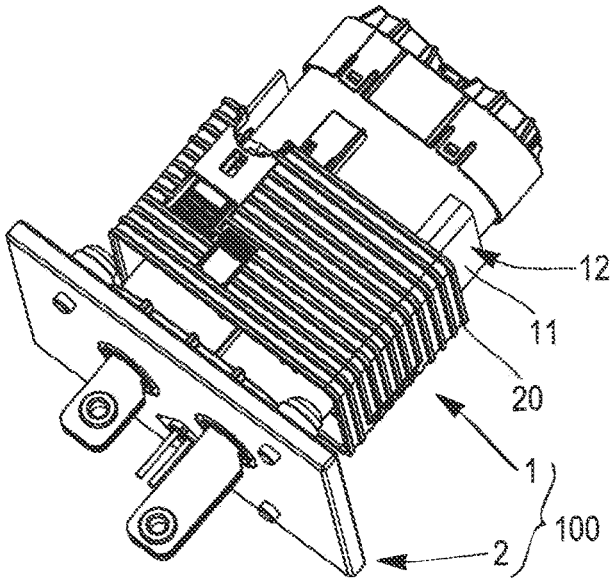
FIG. 1 is a perspective view of two electrical connectors used to form an electrical connector assembly, the two electrical connectors being mated.
Figure 2:
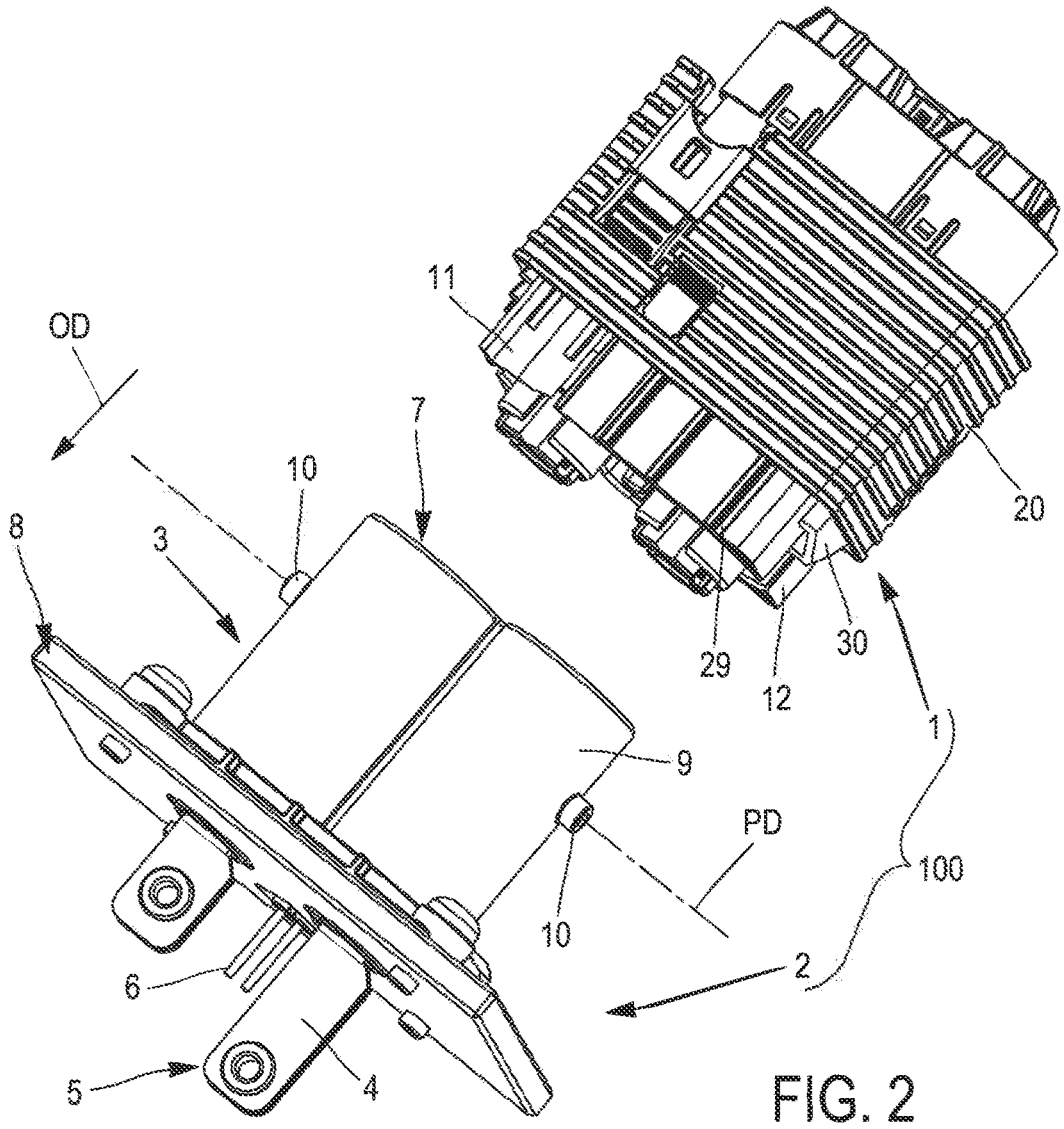
FIG. 2 is a perspective view of the two electrical connectors of the connector assembly shown in FIG. 1, the two electrical connectors being unmated.

An example of a connector assembly 100 is shown in FIGS. 1 and 2. This connector assembly 100 includes a connector 1 and a mating connector 2 or counter-connector. The connector 1 and mating connector 2 are intended to transmit electrical currents, for example ranging from 250 Amps to 600 Amps. In FIG. 1, the connector 1 and the mating connector 2 are mated, the user actuatable member 20 is in the forward position. In FIG. 2, the connector 1 and the mating connector 2 are unmated, the user actuatable member 20 is in the rear position.

The mating connector 2 is for example a male connector with a dielectric housing 3 accommodating two male power terminals 4 extending longitudinally parallel to an operating or mating direction OD. Each terminal 4 has a linking end 5 for a connection with a busbar or a cable. Each terminal 4 also has a connection end (not shown) intended to be mated with a female power terminal (not shown) accommodated in the housing 11 of the connector 1. The mating connector 2 also includes interlock terminals (not shown) electrically linked to signal wires 6.

The housing 3 accommodates each one of the male power terminals 4 in a separate cavity 7. The housing 3 includes a flange 8 for mounting the mating connector 2 onto a wall, a box, or any other equipment. The housing 3 includes walls 9 extending in the operation direction OD, perpendicular to the flange 8. For example, each wall 9 has a generally tubular shape. The housing 3 includes two mounting pins 10. For example, each mounting pin 9 extends radially perpendicular to the operation direction OD, from a wall 9. The two mounting pins 9 are, for example, aligned to each other in the same axis PD and protrude from the housing 3 on opposite directions along this same axis PD. Shielding and sealing means (not shown) are mounted to the mating connector 2.

The connector 1 includes a housing 11, a user actuatable member 20 (or slider), two cam members 30 and two female power terminals (not shown) accommodated in the housing 11. The female power terminals are electrically linked to cables (not shown) with cross sections ranging, for example, between 35 to 95 square millimetres (and possibly even higher). Shielding and sealing means are mounted to the connector 1. The housing 11, the user actuatable member 20 and the two cam members 30 are made of dielectric material. The two cam members 30 are identical. This reduces the number of different parts to be manufactured and managed. They can be manufactured in the same mould cavity.

Figure 3:
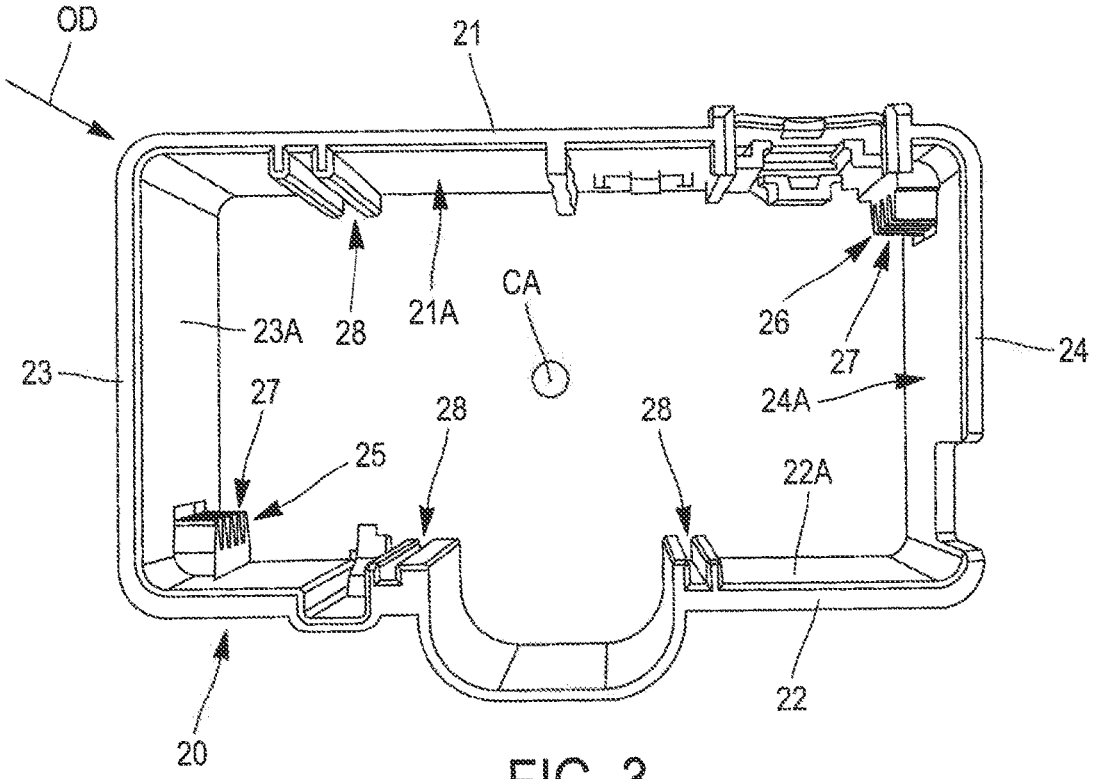
FIG. 3 is a perspective view of the user actuatable member used in the connector assembly shown in FIGS. 1 and 2.

As shown in FIG. 3, the user actuatable member 20 has four walls 21, 22, 23, 24, each one generally extending in planes parallel to a longitudinal central axis CA. The central axis CA is parallel to the operation direction OD. The four walls 21, 22, 23, 24 include an upper wall 21, a lower wall 22 and two lateral walls 23, 24. The four walls 21, 22, 23, 24 define a generally rectangular cross-section. Each one of the four walls 21, 22, 23, 24 has an inner surface 21A, 22A, 23A, 24A. Two adjacent walls chosen among the four walls 21, 22, 23, 24 are perpendicular to each other and define a corner. A first rack section 25 is located on the corner between the lower wall 22 and a lateral wall 23. A second rack section 26 is in an opposite corner, which is between the upper wall 21 and the other lateral wall 24. In other words, the first 25 and second 26 rack sections are located respectively on an inner surface of the user actuatable member 20 and generally symmetrically arranged about the longitudinal central axis CA. The first rack section 25 has teeth 27 extending parallel to the lateral walls 23, 24 in a direction from the lower wall 22 to the upper wall 21. The second rack section 26 has teeth 27 extending parallel to the lateral walls 23, 24 in a direction from the upper wall 21 to the lower wall 22.

The user actuatable member 20 forms a slider which is guided along the operation direction OD with rails 28 slidably engaged in counterpart rails 29 protruding on the outer surfaces of the housing 11 (see FIG. 2). The user actuatable member 20 is slidably mounted to the housing 11, with its upper wall 21, lower wall 22 and lateral walls 23, 24 surrounding the outer surfaces 12 of the housing 11, which are parallel to the operation direction OD.

Figure 4:
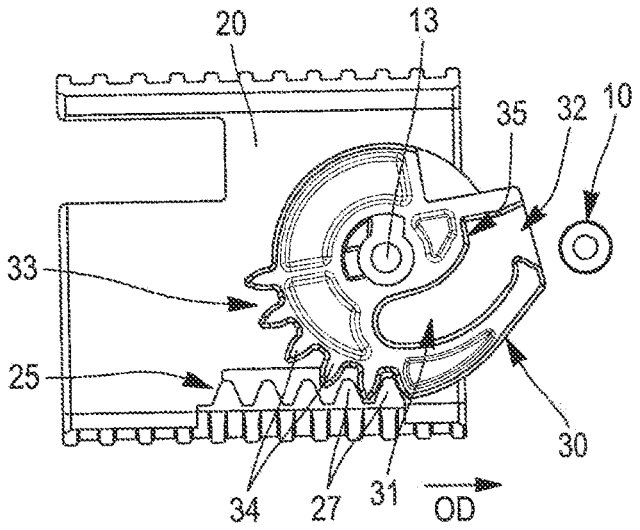
FIG. 4 is schematic diagram of a rack section and a cam member when the user actuatable member of the connector assembly shown in FIGS. 1 and 2 is in the rear position.

Each cam member 30 is rotatably mounted onto an outer lateral surface 12 of the housing, between this outer lateral surface 12 and the inner surface 23A or 24A of a lateral wall 23 or 24 of the user actuatable member 20. As shown in FIG. 4, each cam member 30 rotates about a fulcrum 13 outwardly extending from an outer lateral surface 12 facing a lateral wall 23 or 24. Each cam member 30 has a curved cam slot 31 open on an inlet 32. A cam slot 31 receives a mounting pin 10 extending from a side of a mating electrical connector 2. A cam member 30 has a gear section 33 with teeth 34 engaging the teeth 27 of a corresponding rack section 25 or 26.

When the connector 1 is directed toward the mating connector 2, the connector 1 and the mating connector 2 are oriented in relation to each other so that each mounting pin 10 faces a corresponding cam member inlet 32. Advantageously the user holds the connector 1 by the user actuatable member 20 which is in its rear position. When moving the connector 1 and the mating connector 2 further toward each other, each mounting pin 19 enters a cam slot 31. When each mounting pin 10 abuts a stop surface 35 of the cam slot 31, there is a resistance in the movement of the respective housings of the connector and mating connector toward each other. Then, if the user actuatable member 20 is pushed from its rear position towards its forward position, the first 25 and second 26 rack sections engage the teeth 34 respectively of the first and second cam members 30. As a result, each cam member 30 rotates and the mounting pins 10 are urged and guided in their respective cam slot 31.

Figure 5:
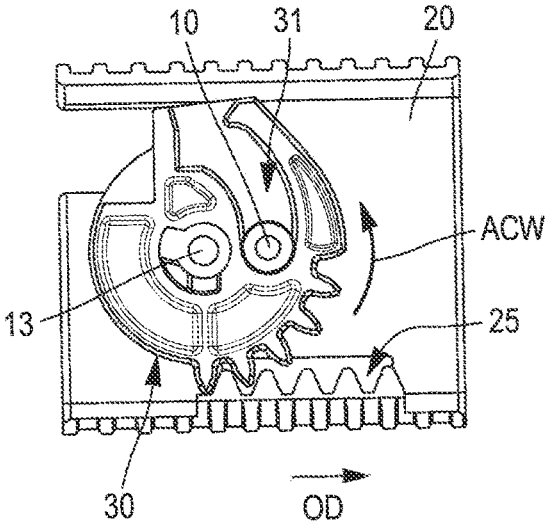
FIG. 5 is schematic diagram of a rack section and a cam member when the user actuatable member of the connector assembly shown in FIGS. 1 and 2 is in the forward position.

As shown in FIG. 5, when the user actuatable member 29 is in its forward position each mounting pin 10 abuts the end of a cam slot 31.

Locking means 40 are slidably mounted along a locking direction parallel to the operating direction, between an unlocking position and a locking position.

In the forward position of the user actuatable member 20, the locking means 40 can be pushed from its unlocking position to its locking position, where it engages at least one of the rotatable cam members 30. Then, the rotation of at least one rotatable cam member 30 is blocked by the locking means 40 and this rotatable cam member 30 can no longer rotate. The user actuatable member 20 is locked as well.

Figure 6:
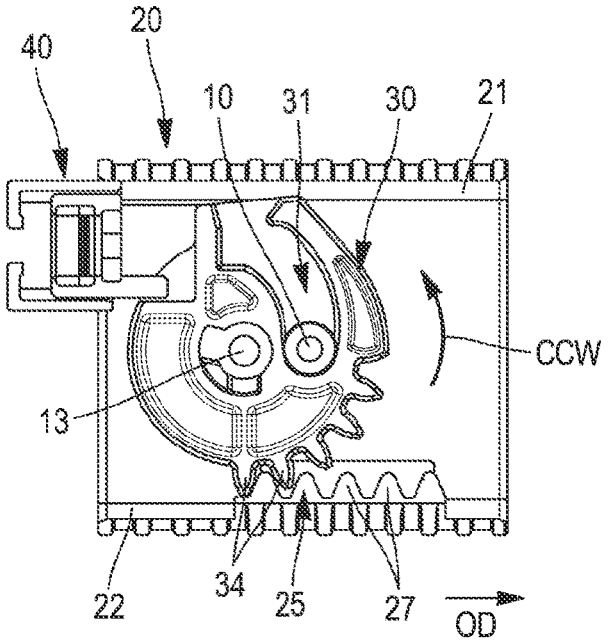
FIG. 6 is a schematic diagram of a rack section and a cam member when the user actuatable member of the connector assembly shown in FIGS. 1 and 2 is in the forward position; and locking means are in a locking position.
Figure 7:
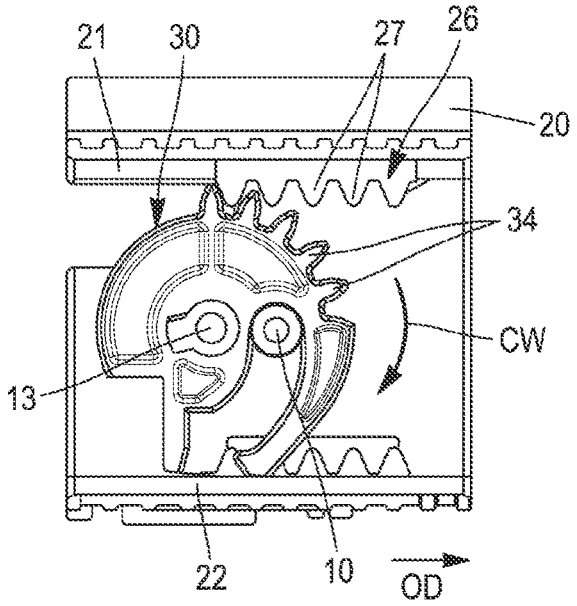
FIG. 7 is a schematic diagram of a rack section and a cam member when the user actuatable member of the connector assembly shown in FIGS. 1 and 2 is in the forward position, the rack section and cam member being arranged on the face of the connector opposite to the one on which are arranged the rack section and the cam member shown in FIGS. 4 to 6.
Figure 8:
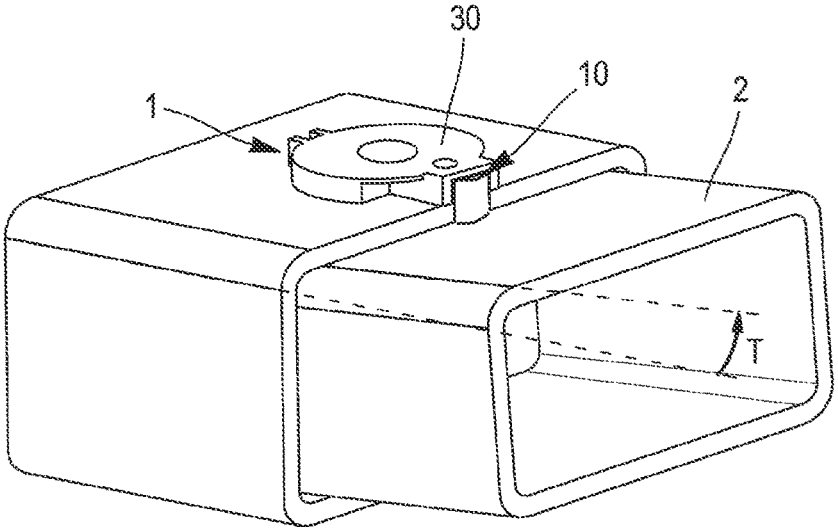
( PRIOR ART ) FIG. 8
FIG. 8 is a perspective view illustrating the rocking movement of the prior art connectors.

The cam members 30 are the same. Consequently, when seen from the same direction, the cam slots 31 are directed in opposite directions (clockwise for one of the cam members, and counterclockwise for the other). The cam member 30 shown in FIG. 6 is shown from the same direction than the cam member 30 shown in FIG. 7. In other words, the cross sections of FIGS. 6 and 7 are seen from the same side of the connector 1. Each cam member 30 is mounted on a respective outer surface 12 so that the teeth 34 of a first cam member 30 engage the teeth 27 of the first rack section 25, which is adjacent to the lower wall 22, and the teeth 34 of a second cam member 30 engage the teeth 27 of the second rack section 26, which is adjacent to the upper wall 21.

As shown in FIGS. 6 and 7, as the user actuatable member 20 is pushed from its rear position to its forward position, a cam member 30 rotates counterclockwise (see arrow CCW in FIG. 6) whereas the other cam member 30 rotates clockwise (see arrow CW in FIG. 7). Consequently, the torques acting between each lateral surface 12 and the corresponding mounting pin 10 are opposite to each other. These torques balance each other so that the connector 1 and the mating connector 2 can slide along the mating direction (parallel to the operation direction OD) without rocking or tilting with respect to each other. The connector 1 and the mating connector 2 remain well aligned, the mating force does not increase, the electrical contact between the terminals and the shielding elements are optimized, and the risk of a seal pinching is decreased, etc.

Further, due to the double mate-assist system (cam member 30/mounting pin 10) the robustness of the connector assembly 100 is increased.

Alternative embodiments of the connector assembly 100 may be envisioned. For example, a connector assembly may be provided with or without electromagnetic shielding and/or with or without a sealing means.

The cam members 30 can be mounted on the user actuatable member 10 and the rack sections 25, 26 can be mounted on the connector housing 11.

The connector 1 can have a third rack section and a fourth rack section and a third rotatable cam member and a fourth rotatable cam member, the third and fourth rotatable cam members are arranged on opposed outer surfaces which are perpendicular to the outer surfaces onto which the first and second rotatable cam members 30 are mounted.

The invention claimed is:

1. An electrical connector comprising:

a housing; and a mate assist system for assisting in mating the electrical connector to a mating electrical connector, the mate assist system comprising:

a user actuatable member longitudinally slidably mounted on the housing configured to slide along an operating direction between a rear position and a forward position having an upper wall, a lower wall, and two lateral walls extending therebetween, wherein the user actuatable member defines a first rack section extending parallel to the operating direction located in a first corner and extending from the upper wall and a first of the two lateral walls and a second rack section extending parallel to the first rack section located in a second corner and extending from the lower wall and a second of the two lateral walls, a first rotatable cam member comprising a cam slot for receiving a first mounting pin extending from a first side of the mating electrical connector, the first cam member having a first gear section with teeth engaging the first rack section, the engagement of the teeth with the first rack section resulting in the rotation of the first cam member in a first direction of rotation when the user actuatable member is actuated from the rear position to the forward position, a second rotatable cam member comprising a cam slot for receiving a second mounting pin extending from a second side of the mating electrical connector, the second side being opposite to the first side of the mating electrical connector, the second cam member having a second gear section with teeth engaging said second rack section, the engagement of the teeth of the second gear section with the second rack section resulting in the rotation of the second cam member in a second direction of rotation when the user actuatable member is actuated from the rear position to the forward position, the first direction of rotation being opposite to the second direction of rotation when the first cam member and the second cam member are seen from a same side of the connector.

2. The electrical connector according to claim 1, wherein the first and second cam members rotate about a shared axis.

3. The electrical connector according to claim 1, wherein the user actuatable member comprises the first and second rack sections and the first and second rotatable cam members are rotatably mounted to the housing.

4. The electrical connector according to claim 3, wherein the user actuatable member defines a generally rectangular cross-section and wherein the first and second rack sections are located on an inner surface of the user actuatable member and are generally symmetrically arranged about the longitudinal central axis.

5. The electrical connector according to claim 1, wherein the first and second rotatable cam members are identical.

6. The electrical connector according to claim 1, wherein the housing has four outer surfaces generally extending in planes parallel to a longitudinal central axis and defining a generally rectangular cross-section, the first and second rotatable cam members being each respectively mounted on an opposed outer surface.

7. The electrical connector according to claim 6, wherein the first and second rotatable cam members are each respectively mounted on opposed outer surfaces of the four outer surfaces.

8. The electrical connector according to claim 6, wherein a first pair of the four outer surfaces arranged opposite one another are shorter than a second pair of the four outer surfaces and wherein the first and second rotatable cam members are mounted on the first pair of the four outer surfaces.

9. The electrical connector according to claim 1, further comprising locking means slidably mounted along a locking direction parallel to the operating direction, between an unlocking position and a locking position, wherein the locking means engages at least one of the first and second rotatable cam members when the user actuatable member is in its forward position.

10. An electrical connector assembly, comprising:

the electrical connector according to claim 1; and a mating connector, wherein first and second mounting pins are respectively arranged on opposite outer surfaces of the mating connector housing.

11. The electrical connector assembly according to claim 10, wherein the first and second mounting pins protrude in opposite directions along a shared axis.

12. The electrical connector according to claim 1, wherein the teeth of the first rack extend parallel to the two lateral walls in a direction from the upper wall toward the lower wall and wherein the teeth of the second rack section extend parallel to the two lateral walls in a direction from the lower wall toward the upper wall.

13. The electrical connector according to claim 1, wherein the first corner is diagonally opposite the second corner.

14. The electrical connector according to claim 1, wherein the user actuatable member forms a slider which is guided by a plurality of rails defined by the user actuatable member that are slidably engaged in a plurality of corresponding rails protruding from the four outer surfaces of the housing.

* * * * *